United States Patent [19]

Donan, Jr.

[11] 4,380,407

[45] Apr. 19, 1983

[54] DUAL THRUST ANCHOR SHELL ASSEMBLY

[75] Inventor: David C. Donan, Jr., Manitou, Ky.

[73] Assignee: Waiamea Company, Inc., Manitou, Ky.

[21] Appl. No.: 287,523

[22] Filed: Jul. 27, 1981

[51] Int. Cl.[3] ..... E21D 11/00

[52] U.S. Cl. ..... 405/259; 411/25; 411/27; 411/33

[58] Field of Search ..... 405/259, 260, 261; 411/15, 24–28, 32, 33, 54–72, 75–77, 44–52

[56] References Cited

U.S. PATENT DOCUMENTS

| | | | |
|---|---|---|---|
| 703,796 | 7/1902 | Lakhovsky | 411/54 |
| 2,918,840 | 12/1959 | Roesler | 411/33 |
| 2,950,602 | 8/1960 | Lang | 405/259 |
| 4,187,757 | 2/1980 | Frischmann et al. | 411/47 X |

FOREIGN PATENT DOCUMENTS

| | | | |
|---|---|---|---|
| 2641442 | 3/1978 | Fed. Rep. of Germany | 411/54 |
| 989834 | 4/1965 | United Kingdom | 411/76 |

*Primary Examiner*—Dennis L. Taylor

*Attorney, Agent, or Firm*—Cahill, Sutton & Thomas

[57] ABSTRACT

A dual thrust anchor shell assembly for use with mine roof bolts or rock bolts include first and second opposed pivotal upper wing elements and first and second opposed, pivotal lower wing elements disposed about a mine roof bolt between a movable upper nut and a fixed lower nut so that tightening of the roof bolt forces the upper wing elements downward toward the lower wing elements. The upper wing elements each have a plurality of sloped camming surfaces. The lower wing elements also each have a plurality of sloped camming surfaces that engage camming surfaces of the upper wing elements as the roof bolt is tightened. Tightening of the roof bolt first causes the upper wing elements to pivot outward and dig into the walls of a roof bolt hole, anchoring the upper wing elements. Further tightening of the roof bolt causes a roof plate to be drawn tightly against the mine roof, binding strata of the mine roof and reinforcing the mine roof. Still further tightening of the roof bolt, if necessary, causes outward pivoting of the lower wing elements, further anchoring the dual thrust anchor shell assembly in the roof bolt hole.

9 Claims, 6 Drawing Figures

DUAL THRUST ANCHOR SHELL ASSEMBLY

BACKGROUND OF THE INVENTION

The invention relates to anchor shell assemblies for use in conjunction with mine roof bolts and rock bolts.

A variety of mine roof bolt assemblies are known in the art. They usually include a bolt of from three to six feet in length, a roof plate or support plate through which the roof bolt extends, and an expansion shell assembly threaded onto a threaded upper end of the roof bolt. A mine roof bolthole is drilled, usually perpendicular to the surface of the mine roof, and the expansion shell assembly installed on a roof bolt is inserted into the roof bolt hole, such that the support plate abuts the mine roof. The roof bolt then is tightened, causing the expansion shell assembly to expand, thereby anchoring the entire assembly, including the roof bolt, to the mine roof strata and forcing the support plate upwardly against the mine roof. Mine roof strata is composed of various layers of different types of rock having varying strength characteristics. It has been long known that a plurality of spaced mine roof bolts installed in mine roof tends to bind the various layers of mine roof strata together and prevents "slippage" therebetween and greatly increases the strength of the laminated strata structure, thereby preventing "cave-ins" of the mine roof.

However, in mine roof strata that is in the range from "medium hard" to "soft", conventional anchor shells, such as those shown in U.S. Pat. Nos. 691,921 and 3,139,730, are not always effective, and cave-ins occasionally occur even when such anchor shells have been utilized in conjunction with mine roof bolts to attempt to bind the mine roof strata together. Such conventional anchor shells generally exert compressive forces radially outward from the roof bolt shank as the expansion "wings" thereof swivel radially outward from the base of the anchor shell. A common limitation of conventional anchor shells is that when the conventional anchor shell is attached to the threaded end of the roof bolt, the threaded end is permitted to extend too close to the bail (bight), so that as the wedge nut advances down the bolt stem the end of the bolt stem contacts the bail before the wedge nut has caused the wings to expand sufficiently to provide anchorage against the bolt hole wall.

Another common limitation of conventional bolt anchors is that in soft strata, there is insufficient expansion (limited range of outward movement) to penetrate deeply enough to provide anchorage. In this situation, the bolt simply pulls the anchor downward until the wedge nut reaches the end of the threads on the bolt (standard thread length on the bolt is about 6 inches) and no anchorage is provided. For example, in the device shown in U.S. Pat. No. 3,022,700, the anchor shell assembly includes a bight portion that is forced upward by the roof bolt as it is tightened, pulling the outer portion of the anchor shell upward, while the threads of the roof bolt force a wedge nut between the outer portions of the anchor shell, causing them to expand and engage the walls of the roof bolt hole. If the material surrounding the roof bolt hole is so hard that little expansion of the outer portion of the anchor shell can occur, the torque required to further tighten the roof bolt may increase to a level greater than the specified torque limit before the base plate is drawn against the mine roof surrounding the roof bolt hole, in which case that roof bolt performs no useful function.

Most conventional anchor shells expand outward radially exerting a horizontal (longitudinal) compressive force against the bolt hole wall. Some shells have a slight outward pivot motion from the lower end of the shell, but lack a large amount of pivotal motion outward, and also lack pivotal motion from both ends of the shell. However, if an anchor shell can allow a large degree of pivotal action of the expansion wings, there is a resulting capacity for greater penetration depths of the wings into the roof strata. This can be advantageous in soft to medium hard strata.

Accordingly, it is an object of the invention to provide an improved expandable shell assembly for a roof bolt or the like that can be adequately anchored into either hard or soft mine roof strata surrounding a roof bolt hole and adequately draw a roof plate against the roof in either case.

It is another object of the invention to provide an expandable anchor shell assembly that digs into relatively soft mine roof strata to provide an adequate anchor for a mine roof bolt and also tightly engages hard mine roof strata surrounding a roof bolt hole without greatly increasing the torque required to further tighten the roof bolt.

It is another object of the invention to provide an improved expandable anchor shell assembly that allows adequate forcing of a base plate against the portion of a mine roof surrounding a roof bolt hole, wherein the anchor shell assembly is anchored in either relatively soft or relatively hard mine roof strata.

SUMMARY OF THE INVENTION

Briefly described, and in accordance with one embodiment thereof, the invention provides an expandable anchor shell assembly for effectively anchoring mine roof bolts and forcing base plates tightly against the portion of a mine roof surrounding a roof bolt hole regardless of whether the mine roof strata surrounding the roof bolt hole and engaging the dual thrust anchor shell assembly is relatively soft or relatively hard by providing first and second upper pivotal wing elements, each having camming surfaces and first and second lower pivotal wing elements interdigitated between the first and second upper wing elements and having camming surfaces that engage camming surfaces of the first and second upper wing elements to cause pivoting and outward expansion of the first and second upper wing elements and first and second lower wing elements in response to tightening of the roof bolt. In the described embodiment of the invention, the expansion of the first and second upper wing elements occurs prior to expansion of the lower wing elements, causing the upper wing element to engage the surrounding mine roof strata and prevent further downward movement of the anchor shell assembly in response to further tightening of the roof bolt. Further tightening of the roof bolt then draws the base plate tightly against the mine roof, binding the overlying strata together and strengthening it, regardless of whether further expansion of the anchor shell assembly occurs. In the described embodiment of the invention, the first and second upper wing elements are disposed on opposite sides of the shaft of the roof bolt and include separate pieces held together by an elastic band or sheath that prevents the first and second upper wing elements from being separated, yet allows the lower portions thereof to pivot outwardly. Each of the first and second wing elements has an upper camming surface and a lower camming surface. The first and second lower wing elements are similarly constructed, each being held against the other by a second elastic band or sleeve, and each having an upper camming surface. The first lower wing element has two lower camming surfaces that engage the lower camming surfaces of the first and second upper wing elements, respectively, when the roof bolt is tightened. The upper camming surfaces of the first and second lower wing elements engage the upper camming surfaces, respectively, of the first upper wing elements in response to a sufficient amount of tightening of the roof bolt. A fixed nut and retaining washer engage the bottom of the first lower wing element to prevent it from moving relative to the roof bolt shaft. An upper nut threadably engaging the roof bolt shaft threads engages the upper portion of the first upper wing element to prevent rotation of the upper nut, so that when the roof bolt is tightened, the upper nut forces the first and second upper wing elements downward. The lower camming surfaces of the first and second upper wing elements engage the lower camming surfaces of the first lower wing element as the roof bolt is tightened, causing pivoting and outward expansion of the lower portions of the first and second upper wing elements, which engage the mine roof strata and if that mine roof strata are sufficiently soft, dig into it. Further tightening of the roof bolt then draws the roof bolt upward, which faces the base plate tightly against the mine roof surrounding the roof bolt hole even before the upper camming surfaces of the first and second lower wing elements engage the upper camming surfaces of the first and second upper wing elements. As the first and second lower wing elements are drawn upward by such further tightening of the roof bolt, a point is reached at which little or no further expansion of the upper wing elements occurs, if the surrounding strata are very hard. Eventually, if the torque limit is not exceeded, and further tightening of the roof bolt takes place, the first and second lower wing elements are drawn sufficiently close to the first and second upper wing elements that the upper camming surfaces of the first and second lower wing elements engage the upper camming surface of the first and second upper wing elements, causing outward expansion of the first and second lower wing elements. The first and second lower wing elements consequently engage the surrounding mine roof strata, more securely anchoring the dual thrust expandable shell assembly in the roof bolt hole after the base plate has been drawn tightly against the portion of the mine roof surrounding the roof bolt hole.

DESCRIPTION OF THE INVENTION

Figure 1:
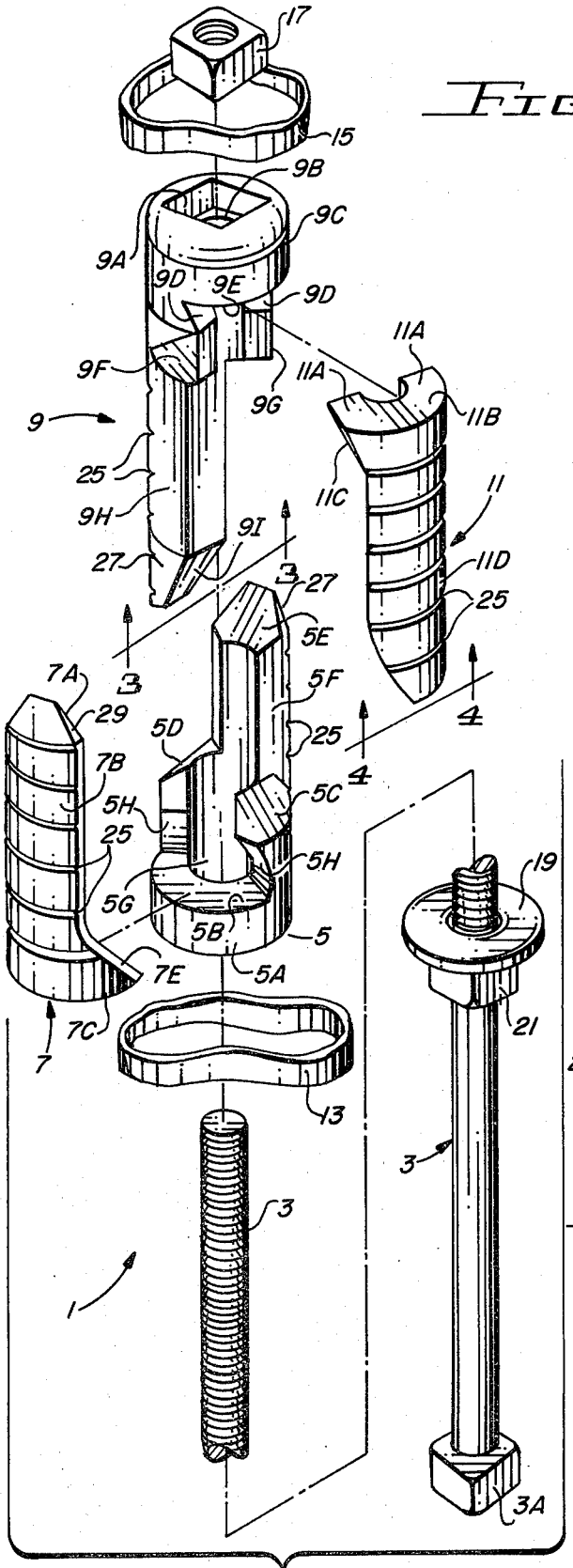
FIG. 1 is an exploded view of the dual thrust anchor shell assembly of the present invention disposed about a mine roof bolt, the roof plate or base plate of the mine roof bolt being omitted for clarity.
Figure 2:
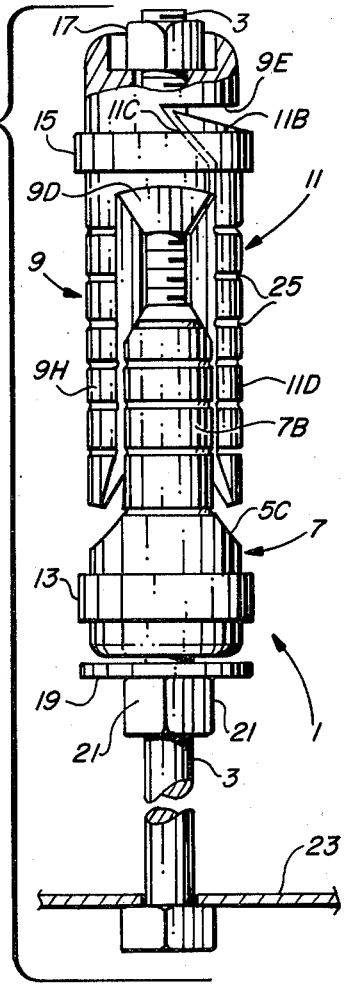
FIG. 2 is a non-exploded side view of the assembly shown in FIG. 1, with a portion of the base plate being shown.

Referring now to the drawings, particularly FIGS. 1 and 2, dual thrust expandable anchor shell assembly 1 (hereinafter referred to simply as anchor shell assembly 1) is disposed about a mine roof bolt 3 having a lower head 3A that forces a roof plate or base plate 23 (FIG. 2) upward against the portion of a mine roof surrounding a roof bolt hole 29 (FIG. 5A) in which anchor shell assembly 1 is anchored. A fixed retaining nut 21 is disposed on the lower end of the threaded portion of roof bolt 3 and supports a washer 19. The threaded portion of roof bolt 3 extends through anchor shell assembly 1, which includes lower wing element 5, lower wing element 7, upper wing element 9, and upper wing element 11. Anchor shell assembly 1 also includes a movable upper nut 17 that is threaded onto the upper portion of roof bolt 3, an elastic band or sleeve 15 that holds upper wing element 11 against upper wing element 9 in a mating relationship therewith, and a lower elastic band or sleeve 13 that holds lower wing element 7 against lower wing element 5 in a mating relationship therewith.

First lower wing element 5 includes a cylindrical base portion 5A having a flat, horizontal, semi-annular surface 5B.

Lower wing element 5 includes first and second sloped, flat camming surfaces 5C and 5D that are positioned symmetrically opposed to each other and are disposed a predetermined distance above surface 5B, as shown in FIG. 1.

Wing element 5 includes an upper camming surface 5E sloped upward from the inner to the outer portion of wing element 5. Upper camming surface 5E is disposed at the tip of a finger portion 5F that has roughly the appearance of a quarter of a cylinder having a hole with the radius of hole 5G bored axially therethrough.

Lower camming surfaces 5C and 5D are sloped upward from the outer vertical wall portions of wing element 5 to the inner portion through which the shaft of roof bolt 3 extends.

Lower wing element 7 includes an upper camming surface 7A that slopes upward from an inner portion of wing element 7 to an outer portion, and is approximately symmetrically opposed to upper camming surface 5E of wing element 5. Camming surface 7A is supported on a finger-like section 7B that has the appearance of a quarter-cylinder. The lower portion of wing element 7 tapers outward to form an enlarged wedge-shaped base 7C of wing element 7. Each side of base 7C comes to a point 7E that fits into one of a pair of V-shaped grooves formed by sloped surfaces 5H and surface 5B of wing element 5.

In the assembled form of annular shell assembly 1, elastic band 13 surrounds the lower portion of wing elements 5 and 7, as shown in FIG. 2, holding wing element 7 against wing element 5 in pivotal relationship thereto, as subsequently explained.

Upper wing element 9 is quite similar in configuration to lower wing element 5, except that upper wing element 9 is inverted, and includes a square nut receiving recess 9A therein for receiving upper nut 17 and preventing rotation of upper nut 17 relative to wing element 9. Upper nut 17 fits somewhat loosely in recess 9A in order to allow tilting of wing element 9 in the manner shown in FIG. 5B, subsequently explained.

Recess 9A is centered about vertical hole 9B, which extends through cylindrical upper portion 9C of wing element 9. Wing element 9 includes a pair of sloped surfaces 9D and a horizontal surface 9E that are similar to the pair of surface 5H and surface 5B, respectively, forming a pair of V-shaped grooves which receive the wedge-shaped upper portions 11A of wing element 11.

Wing element 9 also includes an upper camming surface 9F for engaging camming surface 7A of wing elements 7 and a sloped camming surface 9G for engaging camming surface 5E of wing element 5.

Wing element 9 includes a finger-shaped portion 9H that extends downward and has roughly the appearance of a quarter of a bored cylinder. A lower sloped camming surface 9I is disposed on the lower inner portion of finger-shaped section 9H for engaging camming surface 5D of wing element 5. Camming surface 9I has approximately the same slope as camming surface 5D. Camming surface 9G has approximately the same slope as camming surface 5E of wing element 5. Camming surface 9F has approximately the same slope as camming surface 7A of wing element 7.

Upper wing element 11 has a semi-annular sloped surface 11B (see FIG. 2) and a sloped inner surface 11C that form an enlarged wedge-shaped upper portion that includes the wedge-shaped portions 11A referred to above that fit within the V-shaped grooves formed by surfaces 9D and 9C to allow pivotal movement of wing element 11 relative to wing element 9. (A plurality of grooves 25 are provided in the outer surface of all of the above-described wing elements to provide improved frictional contact of the respective wing elements with the roof strata of the roof bolt hole 29 (FIG. 5A) in which anchor shell assembly 1 is ultimately anchored.) Wing element 11 includes a lower finger-like extension 11D. A sloped camming surface 11E is disposed on the lower inner surface of finger-shaped portion 11D.

Sloped camming surface 11E is approximately parallel to sloped camming surface 5C of wing element 5 and engages it during operation of anchor shell assembly 1, as subsequently explained.

Figure 3:
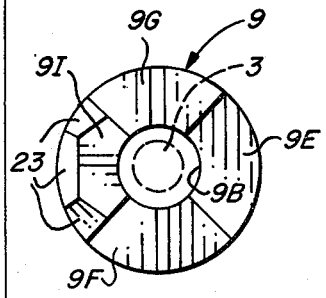
FIG. 3 is a section view taken along section lines 3—3 of FIG. 1.

The relative locations of sloped camming surfaces 9F, 9G and 9I of wing element 9 can be better seen in FIG. 3, which is a bottom view taken along section line 3—3 of wing element 9, as shown in FIG. 1. The position of camming surface 11E on wing element 11 is shown in FIG. 4, which is a bottom view of wing element 11 taken along section lines 4—4 of FIG. 1.

Figure 4:
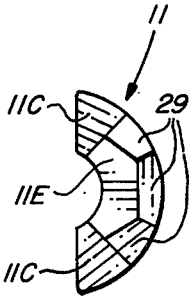
FIG. 4 is a section view taken along section lines 4—4 of FIG. 1.

The regions designated by reference numeral 27 in FIG. 3 are simply blunt end portions of the lower tip of wing element 9, and the regions 29 of FIG. 4 are blunt portions of the lower tip of wing element 11. The same reference numerals are used in FIG. 1 to indicate some of the blunt tip portions of wing element 7 and wing element 5.

FIG. 2 illustrates how the various components shown in FIG. 1 fit together to provide a dual thrust expandable anchor shell assembly installed on roof bolt 3. As can be clearly seen in FIG. 2, the length of finger-shaped portion 7B of wing element 7 is substantially shorter than the finger-shaped portions 11D and 9H of wing elements 11 and 9, respectively. The finger-shaped portion 5F of wing element 5 extends upward to the same height that finger-shaped portion 7B of wing element 7 extends in the installed anchor shell assembly shown in FIG. 1. The reason for providing shorter lengths for the finger-shaped sections of lower wing elements 5 and 7 will become apparent subsequently.

The operation of the dual thrust expandable anchor shell assembly described above will now be described with reference to FIGS. 5A and 5B.

Figure 5A:
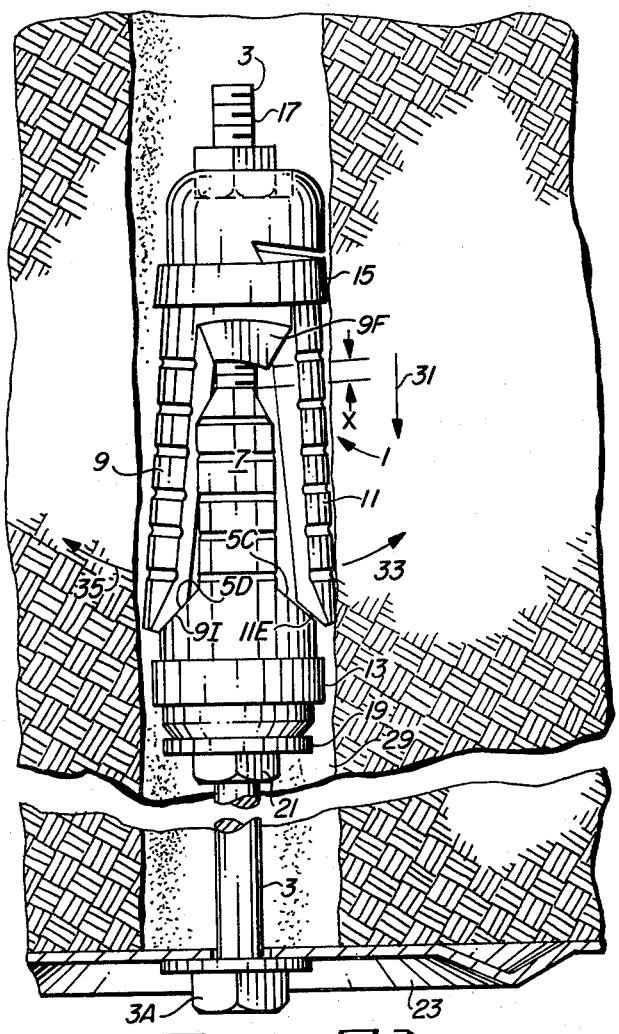
FIGS. 5A and 5B are side views of the dual thrust anchor assembly of FIG. 1 in a mine roof bolt hole, and are useful in describing the operation of the invention.

Referring now to FIG. 5A, anchor shell assembly 1 is shown disposed on the upper portion of a mine roof bolt 3 that extends into a roof bolt hole 29. The head 3A of roof bolt 3 passes through a center opening in roof plate 23 to force portions of the mine roof strata surrounding the mouth or lower portion of roof bolt hole 23 upward when anchor shell assembly 1 becomes anchored in the roof strata and roof bolt 3 is sufficiently tightened.

As shown in FIG. 5A, roof bolt 3 has been tightened only enough to cause lower camming surface 9I of wing element 9 to abut lower camming surface 5D of lower wing element 5 and cause wing element 9 to pivot slightly outward. Similarly, lower camming surface 11E of upper wing element 11 has just abutted lower camming surface 5C of lower wing element 5 so that upper wing element 11 has begun to pivot outward. Note that there is still a substantial distance, designated by "x" in FIG. 5A, between the upper camming surfaces 9F and 9G of wing element 9 and the upper camming surfaces 7A and 5E, respectively, of wing elements 7 and 5. Thus, in FIG. 5A, the lower wing elements 7 and 5 have not begun to pivot outward to the mine roof strata surrounding roof bolt hole 29.

Further tightening of roof bolt 3 causes further downward movement of upper wing elements 9 and 11 in the direction indicated by arrow 31. Fixed retaining nut 21 and washer 19 prevent lower wing elements 5 and 7 from moving downward, relative to bolt 3, so their elevation remains fixed until upper wing elements 9 and 11 become anchored in the roof strata surrounding roof bolt hole 29 and bolt 3 begins to be drawn upward.

Therefore, as upper wing elements 9 and 11 move downward, sloped camming surfaces 9I and 11E slide along camming surfaces 5D and 5C, respectively, causing the lower portions of wing elements 9 and 11 to swing outward in a direction indicated by arrows 35 and 33, respectively.

It can be seen that if recess 9A in the upper portion of wing element 9 (FIG. 1) is sufficiently larger than the dimensions of upper nut 17, and if the bottom surface of upper nut 17 is slightly rounded, wing element 9 can pivot outwardly from the shaft of roof bolt 3.

Elastic band 15 holds the upper wedge portions 11A of wing element 11 in the V-shaped groove formed between surfaces 9E and 9D of the upper portion of wing element 9. The angle of the V-shaped groove of upper wing 9 is substantially greater than the angle of the wedge-shaped portions 11A of wing element 11, so pivoting of wing element 11 can easily occur.

Figure 5B:
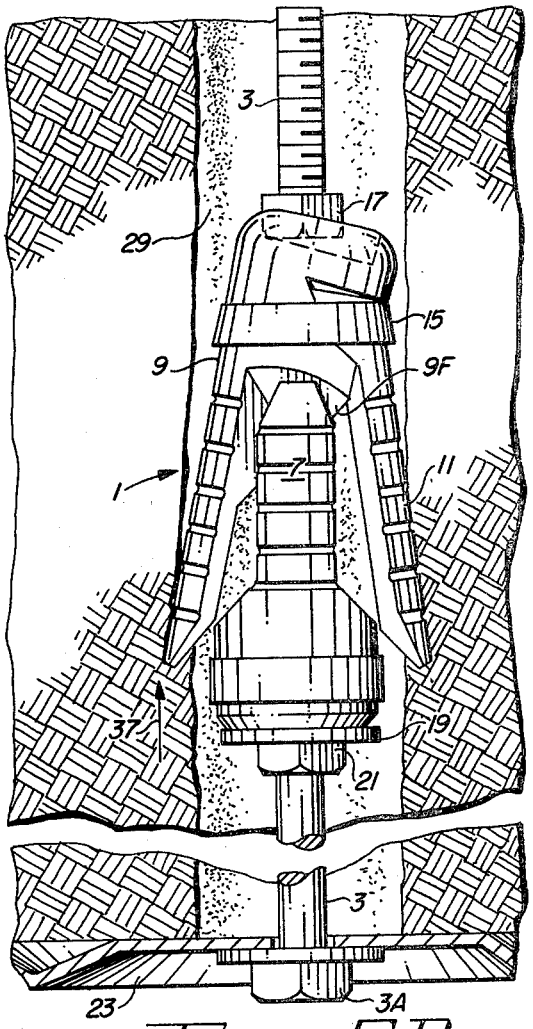

Continued tightening of roof bolt 3 draws upper wing elements 9 and 11 downward and causes them to expand outward in the previously described manner until they dig into and become anchored in the surrounding roof strata, as shown in FIG. 5B. At this point, no further downward movement of wing elements 9 and 11 occurs. The surrounding strata into which the lower tips of upper wing elements 9 and 11 dig and become anchored in, (as shown in FIG. 5B) exerts upwardly and inwardly directed counterforces on upper wings 9 and 11. These counterforces are transmitted through upper wing elements 9 and 11 to upper nut 17, preventing nut 17 from moving further downward as tightening of roof bolt 3 continues. Further tightening of roof bolt 3 therefore causes roof bolt 3, and hence roof plate 23, to be drawn upward.

It should be noted that the distance "x" referred to in FIG. 5A is such that upper camming surfaces 7A and 5E will not meet upper camming surfaces 9F and 9G of wing element 9 until after wing elements 9 and 11 have become anchored in the surrounding mine roof strata and after roof plate 23 has been drawn very tightly toward anchor shell assembly 1 so that the intermediate layers of strata are tightly based together.

Consequently, further tightening of roof bolt 3 causes lower wing elements 7 and 5 to merely move upward in the direction indicated by arrow 37 in FIG. 5B, as a result of the counter force produced on roof bolt 3 and retaining nut 21 by the threads of upper nut 17 (which now remains stationary with wing element 9). Since roof bolt 3 now moves upward, roof plate 23 is also drawn upward, tightly compressing the layered mine roof strata between anchor shell assembly and roof plate 23 together. Usually, a worker will tighten roof bolt 3 to a particular torque specification, for example, 150 ft.-pounds. If the roof strata is very hard, upper wing elements 9 and 11 will not pivot outward very far in a direction indicated by arrows 33 and 35 of FIG. 5A, and as soon as wing elements 9 and 11 become anchored, further tightening of roof bolt 3 draws roof plate 23 toward anchor shell 1. If the above-mentioned torque specification is not met before upper camming surfaces 7A and 5E of wing elements 7 and 5 meet camming surfaces 9F and 9G, respectively, of wing element 9, further tightening of roof bolt 3 causes the upper end portions of wing elements 7 and 5 to pivot outward in the same manner as wing elements 9 and 11, thereby further anchoring anchor shell assembly 1 into the roof strata.

It should now be seen that if anchor shell assembly 1 is surrounded by very hard roof strata so that wing elements 9 and 11 cannot expand very much, the fact that the upper portions 7B and 5F of wing elements 7, 5, respectively, are substantially shorter than portions 9H and 11D of wing elements 9 and 11, respectively, allows continued tightening of roof bolt 3 to occur without a sharp increase in the amount of torque required to turn roof bolt 3, because the lower wing elements 7 and 5 are free to travel upward, thereby allowing the head of roof bolt 3 to draw roof plate 23 to be drawn tightly against the portion of the mine roof surrounding the mouth of roof bolt hole 29. This operation overcomes the tendancy of certain prior anchor shell assemblies to undergo a sharp increase in the amount of torque required to further tighten the roof bolt if the anchor shell assembly is anchored in very hard roof strata.

While the invention has been described with reference to a particular embodiment thereof, those skilled in the art will be able to make various modifications to the disclosed embodiment of the invention without departing from the true spirit and scope thereof. For example, other pivoting arrangements than the disclosed V-shaped and wedge-shaped sections could be used. A single elastic sheath surrounding the entire anchor shell assembly could be used instead of elastic bands 13 and 15.

I claim:

1. An anchor shell assembly for anchoring a bolt in a roof bolt hole, said bolt having a longitudinal axis, a lower head for forcing a roof plate against a portion of a mine roof surrounding the mouth of said roof bolt hole, and a shaft with an upper threaded portion said anchor shell assembly comprising in combination:

(a) a first upper expansion member disposed pivotally relative to said axis, said first upper expansion member including an upper portion having first and second upper camming surfaces that are sloped relative to said axis, and an elongated lower portion, said elongated lower portion having a lower camming surface that is sloped relative to said axis;

(b) a second upper expansion member disposed pivotally relative to said axis and adjacent to said first upper expansion member, said second upper expansion member having an elongated lower portion disposed on an opposite side of said shaft from said lower elongated portion of said first upper expansion member, said lower elongated portion of said second upper expansion member having a lower camming surface that is sloped relative to said axis;

(c) a first lower expansion member disposed pivotally relative to said axis, said first lower expansion member having a lower portion having first and second lower camming surfaces that are sloped relative to said axis, and an elongated upper portion having an upper camming surface that is sloped relative to said axis;

(d) a second lower expansion member disposed, pivotally relative to said axis and adjacent to said first lower expansion member, said second lower expansion member having an elongated upper portion disposed on the opposite side of said shaft from said elongated upper portion of said first lower expansion member, said upper portion of said second lower expansion member having an upper camming surface that is sloped relative to said axis;

(e) threaded nut means disposed on said threaded portion of said shaft for forcing said first and second upper expansion members toward said first and second lower expansion members in response to tightening of said bolt; and (f) retaining means for retaining said first and second lower expansion members in fixed longitudinal relationship to said bolt during tightening of said bolt, said lower camming surfaces of said first and second upper expansion members engaging said first and second lower camming surfaces of said first and second lower expansion members during said tightening of said bolt, forcing said lower portions of said first and second upper expansion members outward into roof strata surrounding the portion of said bolt adjacent to said anchor shell assembly to prevent further downward movement of said first and second upper expansion members in said roof bolt hole, an initial distance between said lower camming surfaces of said first upper expansion member and one of said first and second lower expansion members being substantially less than a corresponding initial distance between said upper camming surfaces of said first upper expansion member and one of said first and second lower expansion members, whereby further tightening of said bolt forces said roof plate tightly upward against the portion of the mine roof surrounding the mouth of said roof bolt hole before said upper camming surface of one of said first and second upper expansion members engages said upper camming surface of one of said first and second lower expansion members, respectively.

2. The anchor shell assembly of claim 1 wherein the said upper portion of said first upper expansion member surrounds said shaft and has a V-shaped groove therein, and wherein said second upper expansion member has a wedge-shaped upper portion pivotally disposed in said V-shaped groove, said anchor shell assembly further including an elastic band disposed around said upper portions of said first and second upper expansion members to maintain said wedge-shaped portion in said V-shaped groove.

3. The anchor shell assembly of claim 1 wherein said lower portion of said first lower expansion member surrounds said shaft and has a V-shaped groove therein, and wherein said second lower expansion member has a wedge-shaped lower portion that pivotally extends into said V-shaped groove of said first lower expansion member, said anchor shell assembly including a second elastic band surrounding said lower portions of said first and second lower expansion members to hold said wedge-shaped lower portion of said second lower expansion member in said V-shaped groove of said first lower expansion member.

4. The anchor shell assembly of claim 3 wherein said elongated lower portion of said first upper expansion member is partially disposed in a space between said elongated upper portions of said first and second lower expansion members, and wherein said elongated lower portion of said second upper expansion member is partially disposed in a second space between said upper portions of said first and second lower expansion members.

5. The anchor shell assembly of claims 2 and 3 wherein the slopes of said upper camming surfaces of said first upper extension member are oriented upward from inner to outer portions of said first upper expansion member and said upper camming surfaces of said first and second lower expansion members are substantially parallel to said first and second upper camming surfaces, respectively, and wherein said first and second lower camming surfaces of said first and second lower expansion members, respectively, are sloped downward from inner to outer portions of said lower expansion member, and said lower camming surfaces of said first and second upper expansion members are substantially parallel to said first and second lower camming surfaces, respectively, of said first lower expansion members.

6. The anchor shell assembly of claim 5 wherein said first elastic band includes a rubber band.

7. The anchor shell assembly of claim 6 wherein said threaded nut means includes a nut, and said first upper expansion member has a nut receiving recess for receiving said nut, preventing rotation of said nut relative to said first upper expansion member, and allowing pivoting of said first upper expansion member relative to said shaft.

8. The anchor shell assembly of claim 7 wherein said retaining means includes a nut disposed in a fixed position on the lowest threaded portion of said bolt and a washer disposed between that nut and said first expansion member.

9. An anchor shell assembly for anchoring a bolt in a roof bolt hole, said anchor shell assembly comprising in combination:

(a) an upper expansion member disposed pivotally relative to said bolt, said upper expansion member including an upper portion having a first camming surface and a lower portion having a second camming surface;

(b) a lower expansion member disposed pivotally relative to said bolt, said first lower expansion member having a lower portion having a third camming surface and an upper portion having a fourth camming surface;

(c) threaded nut means disposed on a threaded portion of said bolt for forcing said upper expansion member toward said lower expansion member in response to tightening of said bolt; and (d) retaining means for retaining said lower expansion member in fixed longitudinal relationship to said bolt during tightening of said bolt;

said second camming surface engaging said third camming surface during said tightening of said bolt, forcing a lower portion of said upper expansion member outward into roof strata surrounding the portion of said roof bolt adjacent to said anchor shell assembly to prevent further downward movement of said upper expansion member in said roof bolt hole, an initial distance between said second and third camming surfaces being substantially less than a corresponding initial distance between said first and fourth camming surfaces, whereby further tightening of said roof bolt forces said roof plate upward tightly against the portion of the mine roof surrounding the mounth of said roof bolt hole before said first camming surface engages said fourth camming surface.

* * * * *